US006584693B2

(12) United States Patent
DeBolt

(10) Patent No.: US 6,584,693 B2
(45) Date of Patent: Jul. 1, 2003

(54) ERGONOMIC HANDLE FOR SCISSORS

(76) Inventor: Christopher Powell DeBolt, 2320 Cherrystone Dr., San Jose, CA (US) 95128

( * ) Notice: Subject to any disclaimer, the term of this patent is extended or adjusted under 35 U.S.C. 154(b) by 0 days.

(21) Appl. No.: 09/999,548

(22) Filed: Nov. 30, 2001

(65) Prior Publication Data

US 2003/0101592 A1 Jun. 5, 2003

(51) Int. Cl.[7] ..... B26B 13/20
(52) U.S. Cl. ..... 30/232; 30/341
(58) Field of Search ..... 30/232, 341; 16/421

(56) References Cited

U.S. PATENT DOCUMENTS 4,590,936 A 5/1986 Straub et al.
5,168,629 A 12/1992 Willard
5,722,171 A 3/1998 Schmidt
5,979,061 A 11/1999 Demlakian-Apkarian
6,272,754 B1 * 8/2001 Hesprich ..... 30/232

* cited by examiner

*Primary Examiner*—Douglas D. Watts
(74) *Attorney, Agent, or Firm*—Mallinckrodt & Mallinckrodt

(57) ABSTRACT

A scissor is made more ergonomic and comfortable to use by the addition to the upper loop handle of the scissor of an enlarged handle portion that fits into and can be held in the palm of a user's hand without the user's thumb passing through the loop handle. One or more of the user's fingers are passed through the lower loop handle in normal manner to operate the scissor. The enlarged handle portion may be secured to the upper loop handle of existing scissors or scissors may be manufactured with the enlarged handle portion included rather than or in addition to the normal loop handle. As an add on, the enlarged handle portion may include two halves secured together to capture and hold a portion of the upper loop between the halves to thereby secure the enlarged handle portion to the upper loop handle.

12 Claims, 4 Drawing Sheets

ERGONOMIC HANDLE FOR SCISSORS

BACKGROUND OF THE INVENTION

1. Field

Figure 1:
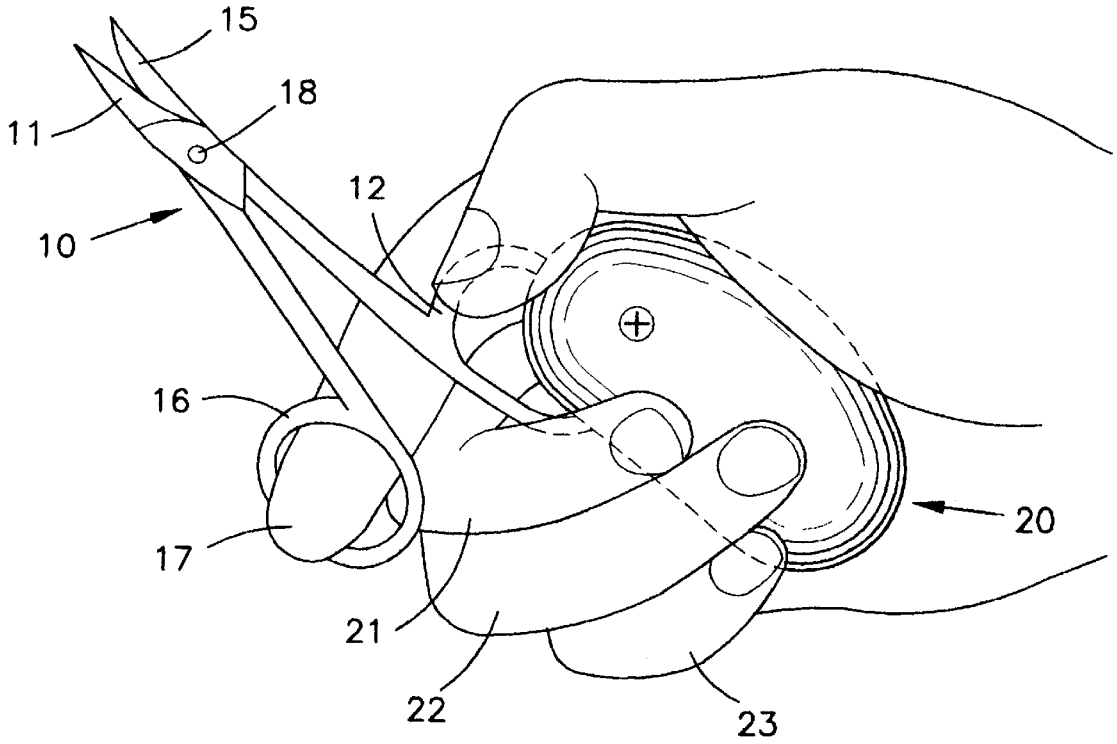

The invention is in the field of scissors or other instruments having blades or arms that pivot with handles at one end of each blade or arm to be held by and operated by a user.

2. State of the Art

There are various configurations of scissors and similar tools, but all have a pair of blades that are pivoted with handles at one end of each blade to be held by a user. Most scissors have a lower handle with a loop through which a user inserts one or more of his fingers to securely hold the scissors or similar tool and an upper handle with a loop through which the user inserts his thumb. The scissor is operated by the user moving his thumb in relation to his fingers to pivot the scissor blades about their pivot point between open and closed positions. In most cases, scissors are uncomfortable to use because they do not fit the users hand very well. It is difficult to provide handles which universally fit most sizes of hands. In addition, scissors are very difficult for a person missing a thumb or fingers to operate.

U.S. Pat. No. 5,979,061 shows a specially designed scissor having a spring handle connecting the two handles of a scissor together and biasing the scissor to open position. A user holds the spring handle in his or her palm and closes the palm to close the scissor and cut desired material. Since this scissor is operated by closing the palm it is a different action than normally used for operating scissors.

U.S. Pat. No. 5,168,629 shows a specially designed scissor having an enlarged lower handle to be held in the user's fingers and an upper handle without a thumb ring upon which the thumb can rest to operate the scissor. Since without the thumb ring the thumb can only force the upper handle downwardly, the scissor has to be biased to the open position.

SUMMARY OF THE INVENTION

According to the invention, the upper handle of a scissor or similar implement includes an enlarged handle portion which can be held in the palm of a user's hand while one or more of the user's fingers fits into the lower normal finger loop of the scissor to operate the lower handle and scissor. This has been found to provide a much easier and more comfortable way to hold and operate a scissors or similar item but does not change the basic operation of the scissor. Further, the scissor can be operated by a disabled person as long as such person has at least two operable fingers. The enlarged handle portion can be an integral part of the upper handle or may be added to the upper handle of an existing pair of scissors so existing scissors can be used with the invention. No specially designed scissors are needed and no biasing of the scissor blades to open position is necessary.

In a preferred embodiment of the invention, the enlarged handle portion is provided as a separate item to be secured to the upper handle of an existing scissor. Various securement schemes may be used. The enlarged handle may be made in two halves which are held together, such as by a screw or similar holding means, to sandwich a portion of the upper scissor loop handle between the two halves of the enlarged handle to thereby secure the enlarged handle to the scissor upper loop handle.

THE DRAWINGS

Figure 2:
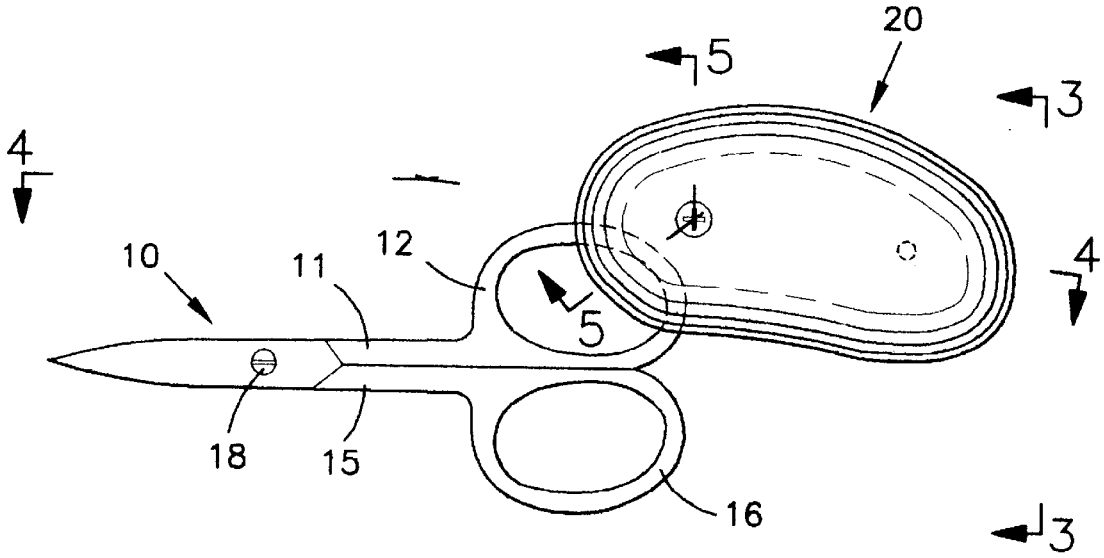
Figure 5:
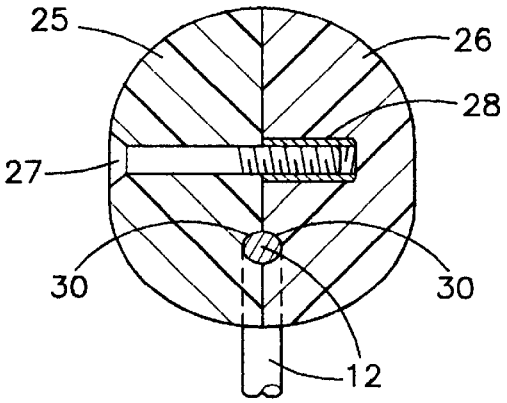
Figure 3:
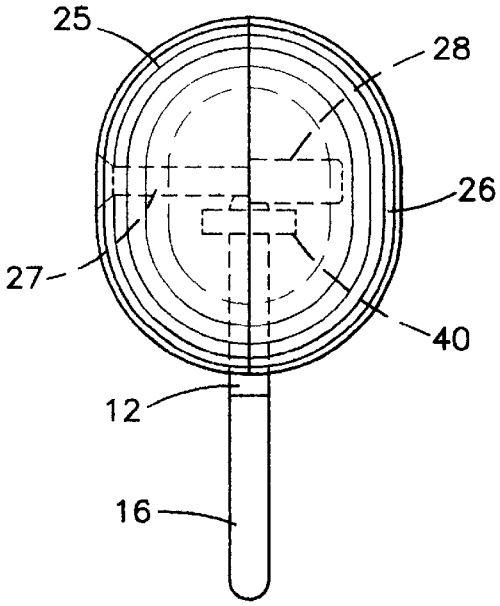
Figure 8:
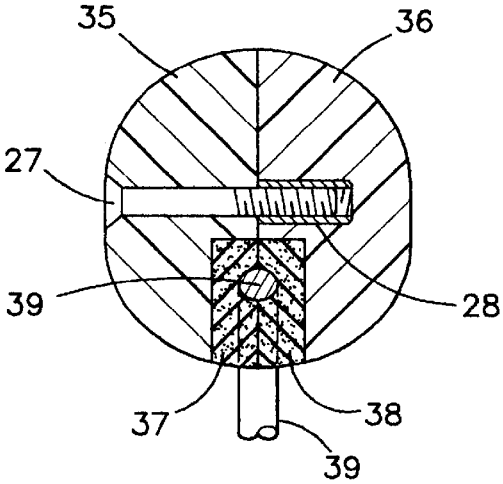
Figure 4:
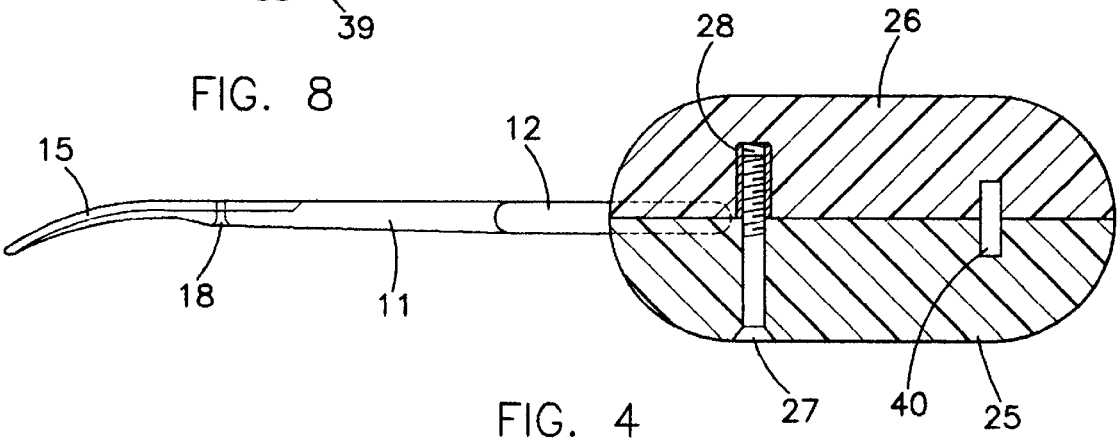
Figures 6, 7:
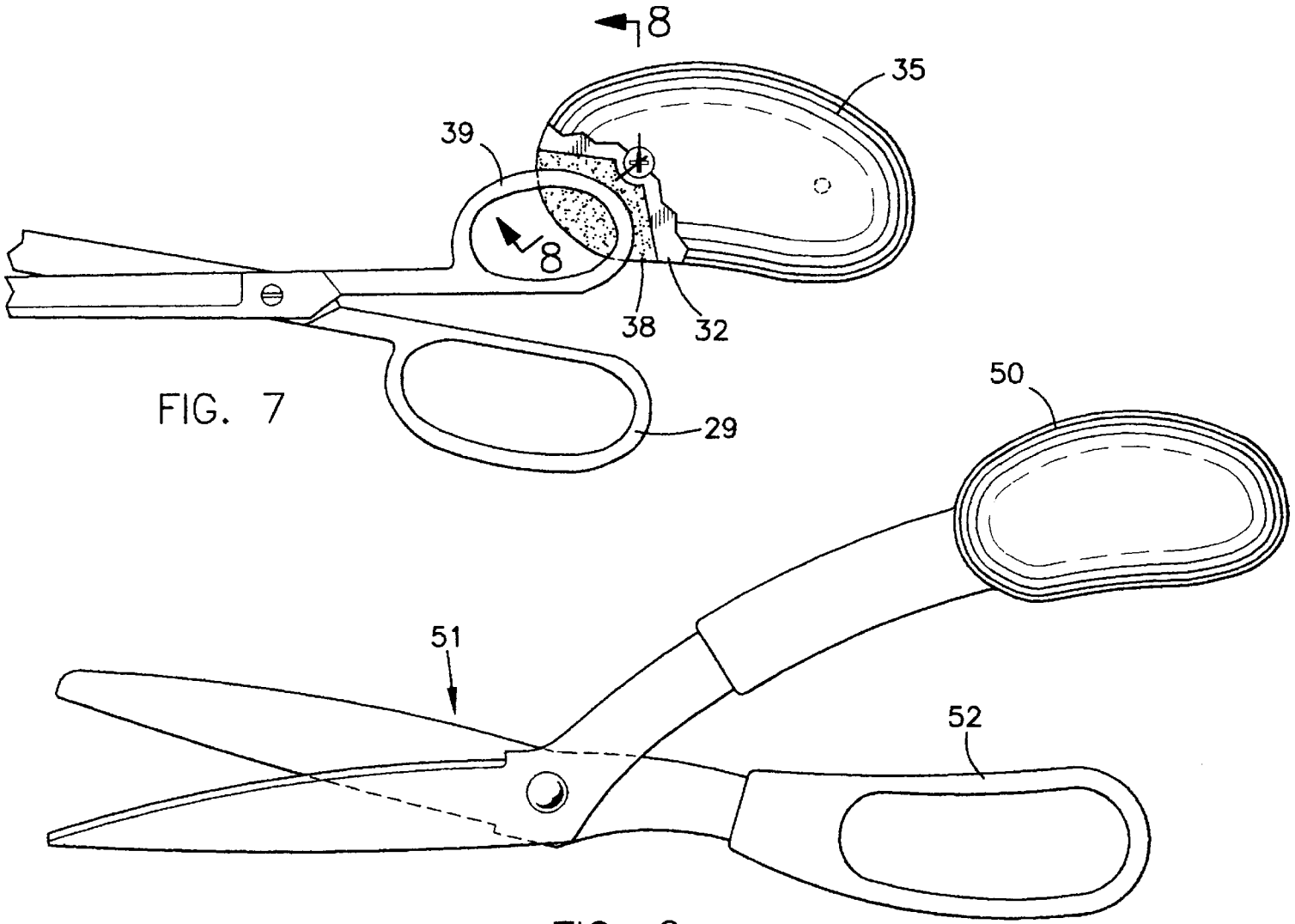
Figure 9:
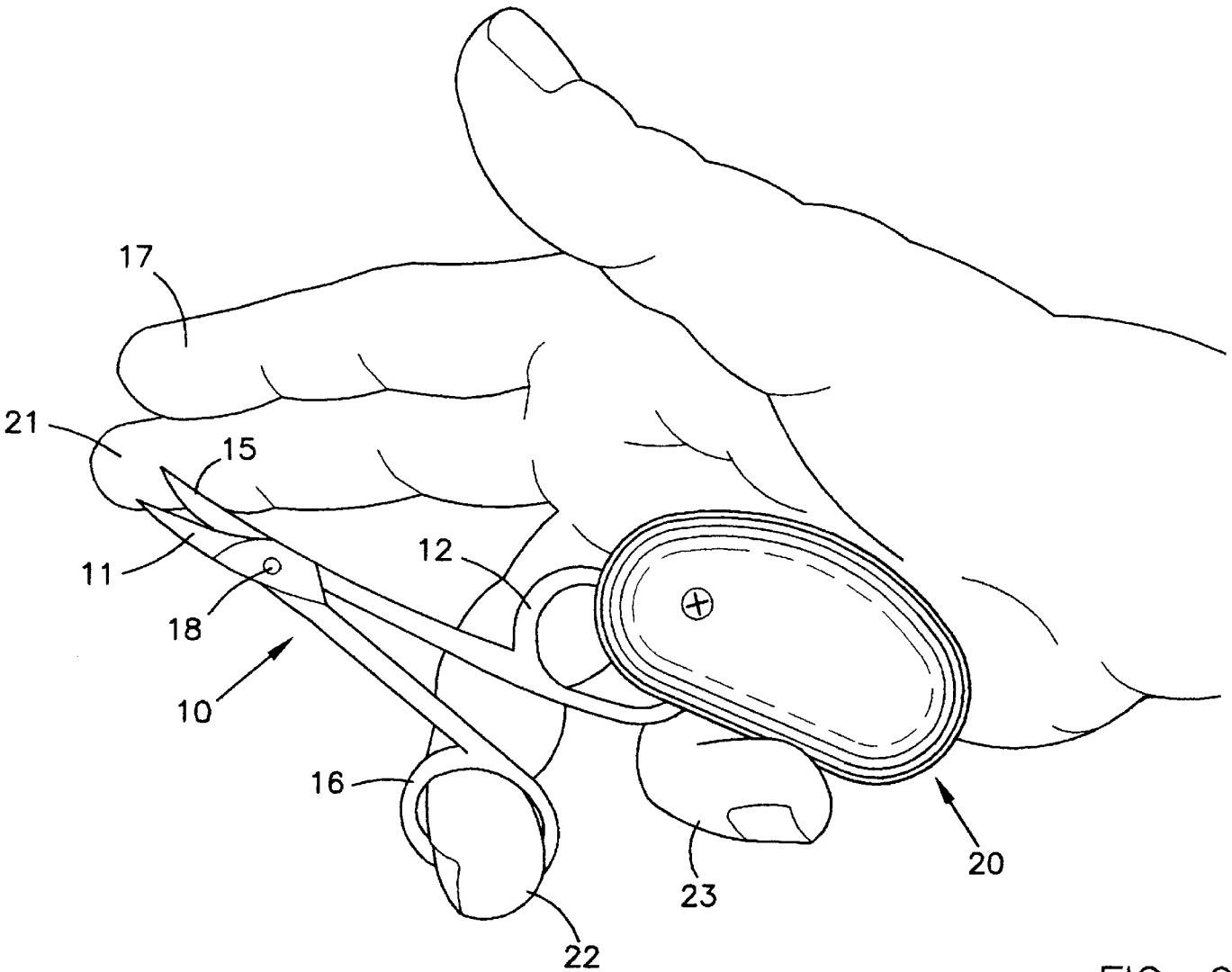

The best mode presently contemplated for carrying out the invention is illustrated in the accompanying drawings, in which:

FIG. 1 is a perspective view of a scissor with the handle of the invention as held for use by a user;

FIG. 2, a side elevation of a scissor with the handle of the invention;

FIG. 3, a rear elevation of the scissor with the handle of the invention taken on the line 3—3 of FIG. 2;

FIG. 4, a top plan view of the scissor of FIG. 2 showing the handle of the invention in horizontal section and taken on the line 4—4 of FIG. 2;

FIG. 5, a section of the handle of the invention taken on the line 5—5 of FIG. 2;

FIG. 6, an embodiment of a scissor with the handle of the invention with the enlarged handle portion forming an integral part of the scissor;

FIG. 7, a further embodiment of the enlarged handle of the invention;

FIG. 8, a section of the handle of FIG. 7 taken on the line 8—8 of FIG. 7; and FIG. 9, a perspective view similar to that of FIG. 1, but showing the scissor handle of the invention held in the user's palm with the user's little finger.

DETAILED DESCRIPTION OF THE ILLUSTRATED EMBODIMENTS

The invention involves the provision of an enlarged handle portion on the top handle of a scissor or similar implement which fits into the palm of a user's hand and is held by the palm of the user's hand so that the thumb is not used to hold the top handle of the scissor. This provides an ergonomic handle for the scissor and also allows the scissor to be held and easily used by a person without a thumb.

As shown in FIGS. 1–5, a scissor, indicated generally as 10, includes a first blade 11 having an upper loop handle 12 at one end thereof adapted to receive a user's thumb 13 and a second blade 15 having a lower loop handle 16 at one end thereof adapted to receive at least one of a user's fingers, here shown as one finger being the user's index finger 17. A pivot pin 18 pivotally connects the first and second blades 11 and 15 so that the first and second loop handles 12 and 16 are adjacent as shown in FIG. 2 when the scissors are in closed position. This is the common construction of all scissors, the scissor shown in FIGS. 1–5 being specifically a nail scissor, but the specific configuration, except for the curved blades, being typical also of school and surgical scissors. References to fingers as used herein do not include the thumb.

The enlarged handle portion 20 of the invention is secured to the upper loop handle 12 and extends rearwardly therefrom increasing the length of the upper handle compared to the lower handle and is configured to fit comfortably in the palm of a user's hand as shown in FIG. 1. With the enlarged handle portion 20 held in the palm of the user's hand, the user's thumb does not extend through the upper loop. One or more of the user's fingers, such as the user's index finger 17, extends through the lower loop handle in normal fashion so the user can operate the scissor. Rather than the index finger, any other finger could be used, such as the middle finger 21, ring finger 22, or little finger 23. In larger lower loops, such as the larger lower loop 29 of FIG. 7, two fingers, such as the index finger 17 and middle finger 21 may both extend through the lower loop 16.

In the illustrated embodiment, enlarged handle portion 20 is made up of two halves 25 and 26, FIGS. 3–5, held together by screw 27 extending through half 25 and threaded into threaded insert 28 secured in half 26. A portion of the upper loop handle 12 is captured and sandwiched between the two halves to secure the enlarged handle portion to the upper loop handle 12. Receiving grooves 30 may be provided in one or the other or both of halves 25 and 26 to receive the captured portion of loop handle 12. Alternately, the handle halves 25 and 26 could be made of a material which deforms to accept handle 12 or, as shown in FIGS. 7 and 8, the handle halves 35 and 36 may have inserts 37 and 38 of deformable resilient material to deform around and hold the portion of the upper loop handle 39 to which it is secured. Further, the handle halves could be hollow or have an enlarged area where the loop 12 passes therebetween so that different configurations of loop can fit therein, the halves contacting and holding the loop where the loop enters and leaves the handle halves. The handle halves are tightened onto the upper loop by tightening screw 27. A pin 40 maintains alignment of the halves although other alignment means such as mating alignment tabs or sizing one half to fit into the other half could be used. Various other means for tightening the handle halves together, such as a ratcheting device to hold the halves together as they are pressed together on the scissor loop, a camming device to tighten the handle halves on the scissor loop, or means for otherwise attaching and securing the enlarged handle to the scissor upper loop could be used. For example, rather than sandwiching the loop between movable handle halves, a hook member could pull a portion of the upper loop handle into a receiving recess in the enlarged handle portion and pull the loop handle portion against the end of the recess to hold it securely in the enlarged handle portion, a camming device could close onto the scissor loop, or a resilient portion of the enlarged handle portion could deform and receive the loop handle portion as it is pushed into the resilient material without separating the handles.

As will be understood from the description so far, the enlarged handle of the invention can be added to any existing scissor or similar implement to provide an ergonomic handle and grip for such instrument. In addition, scissors or similar implements may be manufactured initially with the enlarged handle portion of the invention in place of or in addition to the normal looped handle for the user's thumb. FIG. 6 shows an enlarged handle portion 50 molded as an upper scissor handle on scissor 51 in place of the normal upper loop handle. The normal lower loop handle 52 remains the same as it otherwise would be.

The addition of the enlarged handle portion to an upper scissor loop handle provides a scissor which is easy to hold and operate, even by a person without a thumb and/or without up to two fingers. FIG. 1 shows the enlarged handle portion held in the palm of a user's hand by three fingers of the user's hand while the bottom loop is operated by the first finger. FIG. 9 shows the enlarged handle portion held in the user's palm by the user's little finger 23 and operated by the user's ring finger 22. Thus, the scissor of the invention with the enlarged handle portion can be held and operated by just two fingers. It will be evident from FIGS. 1 and 9, that any two fingers could operate the scissors, not just the fingers shown in the two drawings. Further, in using the enlarged handle with a scissors, the scissors are used in normal fashion. The upper and lower handles are each held in one of the user's hands so the relative movement of the handles away from one another and toward one another is accomplished by relative movement of fingers of the hand. No spring loading of the handles for biasing the handles to a particular position, such as open or closed position, is necessary.

Whereas this invention is here illustrated and described with reference to embodiments thereof presently contemplated as the best mode of carrying out such invention in actual practice, it is to be understood that various changes may be made in adapting the invention to different embodiments without departing from the broader inventive concepts disclosed herein and comprehended by the claims that follow.

What is claimed is:

1. An auxiliary handle for a scissor wherein the scissor includes an upper loop handle adapted to receive a thumb of a user's hand and a lower loop handle adapted to receive one or more fingers of the user's hand, and wherein the upper loop handle has rearward, upper, forward, and adjacent portions, the adjacent portion being adjacent to the lower loop handle when the scissor is in a closed condition, comprising:

an enlarged handle portion configured to fit into and be held in the palm of a user's hand; and securement means for securing the enlarged handle portion to the upper handle of the scissor so that the enlarged handle portion extends upwardly and rearwardly from the upper loop handle and does not interfere with the adjacent portion of the handle and so that the enlarged portion of the upper handle can be held in the palm of the user's hand without the user's thumb extending through the upper loop and with the user's hand substantially behind the upper loop so that the user's fingers holding the enlarged handle portion do not extend over the adjacent portion of the handle and are positioned behind the upper and lower loop handles of the scissor.

2. An auxiliary handle for a scissor according to claim 1, wherein the enlarged handle portion includes two halves which sandwich a portion of the upper and rearward portions of the upper loop handle therebetween to secure the auxiliary handle to the upper loop handle away from the adjacent portion of the upper loop handle.

3. An auxiliary handle for a scissor according to claim 2, wherein the two halves are secured together by a screw which is tightened to sandwich and hold the portion of the upper loop handle between the halves.

4. An auxiliary handle for a scissor according to claim 3, wherein at least one of the halves includes a receiving groove for the portion of the loop handle held between the halves.

5. An auxiliary handle for a scissor according to claim 3, wherein at least one of the halves includes resilient material to receive the loop handle held between the halves.

6. An auxiliary handle for a scissor according to claim 3, wherein the first and second handles of the scissor have lengths and the auxiliary handle extends the length of the first handle beyond that of the second handle.

7. In a scissor having an upper loop handle adapted to receive the thumb of a user's hand and a lower loop handle adapted to receive one or more fingers of the user's hand, and wherein the upper loop handle has rearward, upper, forward, and adjacent portions, the adjacent portion being adjacent to the lower loop handle when the scissor is in a closed condition, the improvement comprising:

an enlarged handle portion extending upwardly and rearwardly from the upper loop handle and away from the adjacent portion of the upper loop handle and does not interfere with the adjacent portion of the upper handle to fit into and be held by the palm of a user's hand behind the upper loop handle without the user's thumb extending through the upper loop handle.

8. A scissor improvement according to claim 7, wherein the enlarged handle portion is attached to an existing upper scissor loop handle and includes two halves which sandwich a portion of the upper and rearward portions of the upper loop handle therebetween to secure the enlarged handle portion to the upper loop handle away from the adjacent portion of the loop handle.

9. A scissor improvement according to claim 8, wherein the two halves are secured together by a screw which is tightened to sandwich and hold the portion of the upper loop handle between the halves.

10. A scissor improvement according to claim 9, wherein at least one of the halves includes a receiving groove for the portion of the loop handle held between the halves.

11. A scissor improvement according to claim 9, wherein at least one of the halves includes resilient material to receive the loop handle held between the halves.

12. A scissor improvement according to claim 7, wherein the upper and lower handles of the scissor have lengths and the enlarged handle portion extends the length of the upper handle beyond that of the lower handle.

* * * * *